United States Patent [19]

Nicholas et al.

[11] Patent Number: 4,674,252

[45] Date of Patent: Jun. 23, 1987

[54] GLAND AND MOUNT SYSTEM AND COMPONENTS THEREOF

[75] Inventors: John D. Nicholas; Larry M. Petree; Julian J. Attaway, all of Tucker, Ga.

[73] Assignee: MM Systems Corporation, Tucker, Ga.

[21] Appl. No.: 831,520

[22] Filed: Feb. 21, 1986

[51] Int. Cl.[4] ..... E04B 1/62

[52] U.S. Cl. ..... 52/396; 404/69

[58] Field of Search ..... 52/396, 403; 404/65, 404/66, 67, 64, 69; 277/205, 207 R

[56] References Cited

U.S. PATENT DOCUMENTS

| | | | |
|---|---|---|---|
| 3,606,826 | 9/1971 | Bowman | 404/64 X |
| 3,918,824 | 11/1975 | Bowman | 404/64 |
| 4,007,994 | 2/1977 | Brown | 52/396 |
| 4,184,298 | 1/1980 | Balzer | 52/396 |
| 4,295,315 | 10/1981 | Lynn-Jones et al. | 404/69 X |
| 4,504,170 | 3/1985 | Schukolinski | 404/67 |
| 4,522,413 | 6/1985 | Nicholas | 404/64 |

*Primary Examiner*—Carl D. Friedman
*Assistant Examiner*—Creighton Smith
*Attorney, Agent, or Firm*—John B. Armentrout

[57] ABSTRACT

Elastomeric glands are disclosed provided with a laterally central chevron wall member which is carried in the gland, rearwardly to narrow and forwardly to widen, by front and back pairs of connecting wall means of the gland which apply thrust against the chevron wall member from relatively movable bodies during the rearward carry, and relieve thrust against the chevron wall member from the relatively movable bodies during the forward carry, under conditions of opposite lateral ends of the gland being supported relatively to move with the bodies and the gland being inside a movement tolerance space between the bodies. Gland and mount systems involving use of the elastomeric glands, and mounts for accommodating elastomeric glands such as of the character indicated and provided with anchors are also disclosed.

34 Claims, 6 Drawing Figures

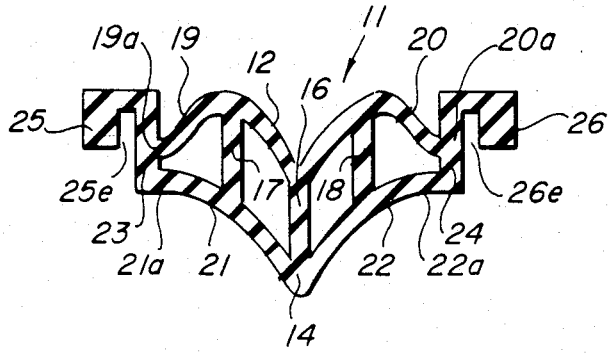
FIG. 2a
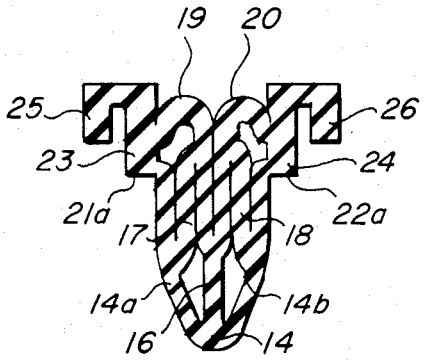
FIG. 2b
FIG. 3
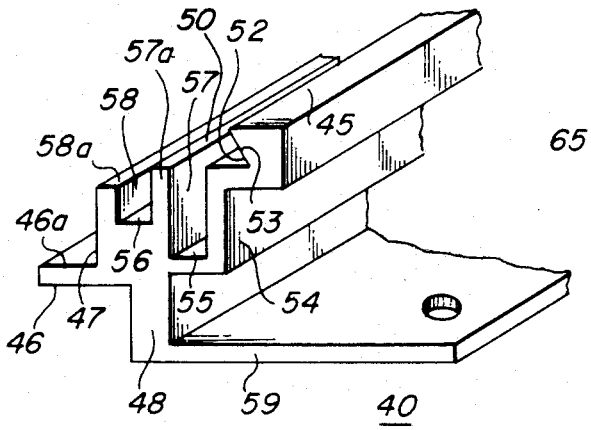
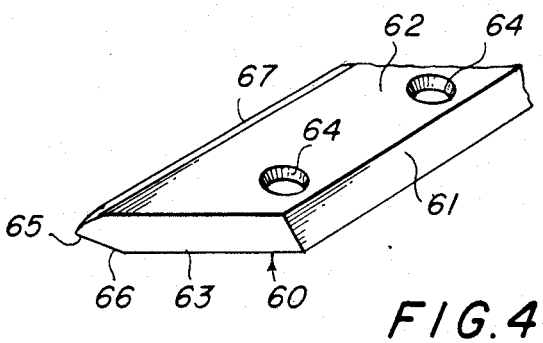
FIG. 4

GLAND AND MOUNT SYSTEM AND COMPONENTS THEREOF

This invention relates to the art of closing off a movement tolerance space between relatively movable bodies, and is more particularly concerned with gland and mount systems and components thereof which are adapted to identify with relatively movable bodies, for bridging across the movement tolerance space between those bodies.

An object of this invention is the provision of commercially feasible elastomeric glands, and gland and mount systems, which are well adapted as glands, or with gland and mount systems, to be associated with relatively movable bodies to close off a movement tolerance space between the bodies and have the gland appropriately narrow and widen laterally with the movement tolerance space.

Another object herein is to achieve elastomeric glands of the character indicated which have quite satisfactorily high compression ratios in terms of width of the gland when the gland is fully relaxed to width of the gland when the gland is fully compressed.

Another object of this invention, in accordance with certain embodiments thereof, is to provide mounts which lend themselves to being associated with elastomeric glands, where the gland has lateral end anchor means to be engaged with the mount, and which mount is characterized by having a base to be secured to a relatively movable body to move therewith for supporting the gland end, and by having cover structure well correlated with the base enabling the gland end anchor to be housed by the mount while quite satisfactorily engaged and covered.

Other objects of this invention in part will be obvious and in part pointed out more fully hereinafter.

As conducive to a clearer understanding of certain features of this invention, it is noted here that elastomeric glands, with or without mounts for opposite lateral ends of the gland, are intended to be associated with space which is made to occur between relatively movable bodies such as between portions of a building structure, or sections of a highway, sidewalk or floor of a bridge. Elastomeric glands, as for example in the environments just named, are often needed to close off movement tolerance space allowing for expansion and contraction of the bodies due to temperature change. In instances where relatively movable bodies are vibrated, such as during an earthquake, glands within spaces closed off by the glands are beneficial against having the bodies directly meet. Other functions often fulfilled by elastomeric glands are numerous, among these being that of serving as a barrier or seal against extraneous matter.

Longitudinally multi-tubular elastomeric glands, being in a fully relaxed condition, can be reduced in width to an extent permitted by the multi-tubular lattice structure thereof, and then the gland can be operated to resume the fully relaxed condition. When the gland structure as defined by the multi-tubular lattice of the gland enables a relatively high compression ratio to be had, based upon width of the gland while the gland is fully relaxed to width of the gland while the gland is fully compressed, this ratio is favorable and stands to represent that the gland will longer allow the movement tolerance space between the relatively movable bodies to be reduced before the gland is fully compressed.

In being compressed, some of the elastomeric glands in the prior art, when used inside a movement tolerance space between relatively movable bodies, will bulge at outer face to extend past the outer faces of the relatively movable bodies, thus to present obstructions and furthermore be prone to wear. The bulges have no worthwhile stress relief and therefore become more pronounced as the gland is further compressed. Although the related compression ratio of the gland may in certain instances prove to be favorable, this would be at the expense of having the gland bulge forwardly unduly to achieve that ratio.

It is accordingly another object of this invention to provide elastomeric glands which are operable with favorable compression ratios and successfully avoid having structure and stresses therein which otherwise could produce objectionably distended gland portions at the front of the gland.

In accordance with the present invention, elastomeric glands are provided for being associated with relatively movable bodies while the gland occupies a movement tolerance space between the bodies. The glands are longitudinally hollow multi-tubular units, formed as by extrusion. There is a chevron wall member laterally centrally of the gland and the chevron wall member defines a front valley-forming portion and a back rib-forming portion along with having a pair of strut walls interconnecting opposite lateral ends of the valley and rib-forming portions. An intermediate strut wall of the gland, inside the chevron wall member, interconnects the valley and rib-forming portions medially of the valley and the rib, while being disposed about equilaterally between the pair of strut walls of the chevron wall member, and defines a pair of longitudinal passageways through the gland with the chevron wall member.

A gland of the character just described is adapted to be supported adjacent to opposite lateral ends thereof within a movement tolerance space between relatively movable bodies for the chevron wall member to be carried rearwardly, within the movement tolerance space, while the gland is being compressed, and to be advanced forwardly when compression against the gland is relieved. This action occurs within the compression and relaxation range of the gland and is enabled by having the chevron wall member carried in the gland by a front pair of connecting walls and by a back pair of connecting walls which have inner lateral ends connected with the pair of strut walls of the chevron wall member adjacent to opposite lateral ends of the valley and rib-forming portions of the chevron wall member. Thrust transmitted by the front and back pairs of connecting walls of the gland promotes having the chevron wall member be compressed. During that time, the valley and the rib defined by the chevron wall member are narrowed, and the intermediate strut wall member moves rearwardly. With having the opposite lateral ends of the gland supported, and the inner lateral ends of the back pair of connecting walls of the gland free to deflect, the front and back pairs of connecting walls are arranged in the gland to carry the chevron wall member backwardly somewhat, to have inner lateral end portions of the front pair of connecting walls more nearly approach one another, to cover where the valley in the chevron wall member beforehand extended, and preferably eventually be abutted against one another. Moreover, in certain embodiments, the inner lateral end portions of the front pair of connecting walls after being abutted against one another, are enabled to be urged farther together at outside faces thereof progressively as the gland continues to be compressed.

By having the chevron wall member bodily carried rearwardly by the front and back pairs of connecting walls, the compression ratio of the gland is improved, and stresses which otherwise would intensify at the front face of the gland are alleviated to reduce bulging. The front pair of connecting walls alleviate by being free in the gland to fill in outside where the chevron wall member has been.

Glands in accordance with the present invention may be allied with relatively movable bodies in many possible ways, such as through use of mount means in system with the gland. The present invention is inclusive of mount means, such as may be used in system with an elastomeric gland of the character hereinbefore set forth, and an embodiment involving the mount means per se and a related system will hereinafter be described.

In the accompanying drawings representing embodiments of this invention which presently are preferred:

Figure 1:
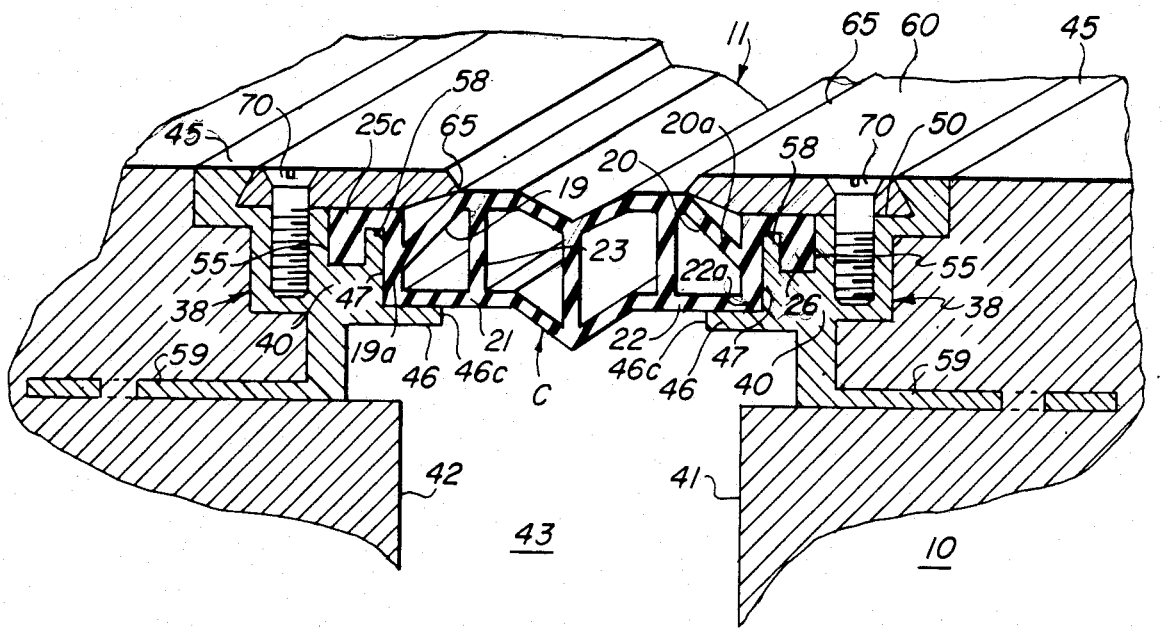
FIG. 1 is a transverse cross-sectional view of an elastomeric gland in system with mounts, in an installation including relatively movable bodies, having the view isometrically prolonged to represent a brief portion of the installation longitudinally of the gland, with the gland being about fully relaxed.
Figure 2:
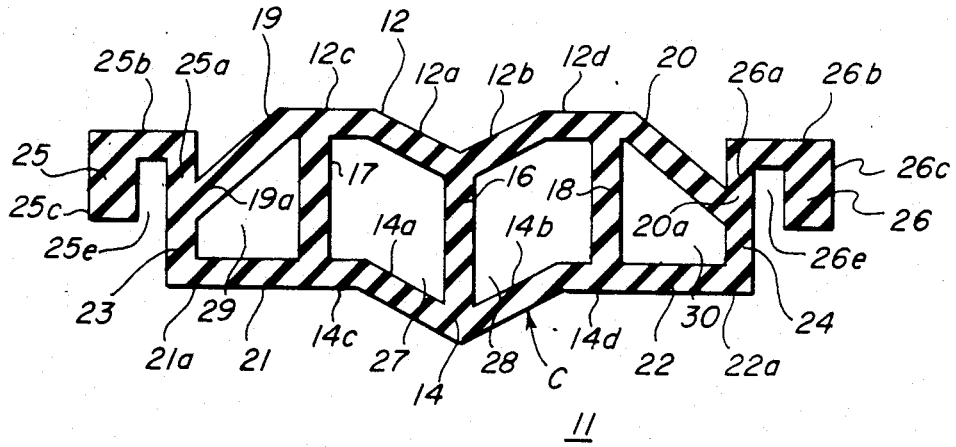
FIG. 2 is a transverse cross-sectional view of the elastomeric gland from FIG. 1, and represents the gland once more in about a fully relaxed condition of the gland.

FIG. 2*a*, corresponding to FIG. 2, is a transverse cross-sectional view of the gland while the gland is partially compressed and is supported in accordance with FIG. 1;

FIG. 2*b* corresponds to FIG. 2*a* and is a transverse cross-sectional representation of the gland with the gland being about fully compressed while supported in accordance with FIG. 1; and FIGS. 3 and 4 are isometric views representing respectively base means and cover means of one of the gland mounts shown in FIG. 1.

Referring to the accompanying drawings, the gland and mount emplacement 10, represented in FIG. 1, includes therein an elastomeric gland 11 and a pair of mounts 38. Gland 11 and the mounts 38 are associated with a pair of relatively movable bodies 41 and 42 which form a movement tolerance space 43 with one another. The bodies 41 and 42 illustratively are slabs or sections of a pavement, such as of a highway, sidewalk or building floor type, and as shown in FIG. 1 have anchor components 59 of the pair of mounts 38 embedded therein. Top lands 45 of the pair of mounts 38, as the latter are installed, are about flush with the outside faces of the bodies 41 and 42.

Where the two bodies 41 and 42 are being produced from a fluent settable material, such as concrete, the pair of mounts 38, or the bases 40 thereof, or any further such mounts, or the bases thereof, needed for longitudinal prolongation, are beneficially used as members of form work, so as to have the lands 45 serves as screeds or guides either in bringing the fluent mix about flush with the lands, or in adding a topping of any desired type over the set fluent mix thereby to have the topping about flush with the lands.

Rest walls 46 on the bases 40 are directed laterally toward one another inside the movement tolerance space 43 when the bases 40 are in place on the relatively movable bodies 41 and 42. The gland 11, as installed, is rearwardly against forward faces of the rest walls 46, while spanning a gap between the rest walls within the movement tolerance space 43 and while laterally endwise being against abutments 47 afforded by the bases 40 of the pair of mounts 38. Gland 11 is further associated with the mounts 38 by being anchored thereto in a manner hereinafter to be described. In certain other embodiments, still in accordance with the present invention, anchor structure of the gland is omitted such as in favor of securing the gland, properly situated on mounts, by use of a suitable adhesive bonding agent.

Gland 11, as represented in FIGS. 1 and 2, is approximately in a fully relaxed condition in order to facilitate an understanding of structure of the gland. Proportionately, the movement tolerance space 43, as shown in FIG. 1, is somewhere near a preferred maximum, illustratively reached by relative movement of the bodies 41 and 42, such as through having had the bodies respond to an expected minimum regional temperature condition. When the movement tolerance space 43 is reduced to be of intermediate width, such as through having the bodies 41 and 42 expand due to an increase in temperature, the gland 11 accordingly is compressed to an intermediate extent, and thereafter the gland 11 and space 43 can widen or narrow concurrently within limits, due to temperature change or other influences encountered by the bodies 41 and 42.

Referring further to the gland 11, and especially to FIG. 2, the gland is characterized in the relaxed condition by having a chevron wall member C which produces two longitudinal passageways 27 and 28 through the gland with an intermediate strut wall 16 of the gland. The chevron wall member C is defined by a pair of strut walls 17 and 18 which are about equidistantly removed laterally from opposite sides of the intermediate strut wall 16 and accordingly lead laterally and longitudinally about parallel with the intermediate strut wall. A front wall portion 12 of the chevron wall member C includes at the front of the gland 11 two inner wall panels 12*a* and 12*b* and two outer wall panels 12*c* and 12*d* which connect outer lateral ends of the inner wall panels 12*a* and 12*b* with forward lateral ends of the strut walls 17 and 18 of the chevron wall member C and form approximately equal obtuse angles with the inner wall panels 12*a* and 12*b* inside the chevron wall member. The inner walls panels 12*a* and 12*b* produce a longitudinal laterally forwardly opening valley with one another outside the chevron wall member C and have inner lateral ends connected with a forward lateral end of the intermediate strut wall 16 of the gland.

At the rear of gland 11, the chevron wall member C has a back wall portion 14 which provides a pair of inner wall panels 14*a* and 14*b* and a pair of outer wall panels 14*c* and 14*d* interconnecting the outer lateral ends of the inner wall panels 14*a* and 14*b* with rearward lateral ends of the strut walls 17 and 18 of the chevron wall member. A pair of obtuse angles formed outside the chevron wall member by the outer wall panels 14*c* and 14*d* with the inner wall panels 14*a* and 14*b* are approximately equal to one another and are approximately equal to each of the obtuse angles in the pair produced by the outer wall panels 12*c* and 12*d* with the inner wall panels 12*a* and 12*b* inside the chevron wall member C. Wall panels 12*a*, 12*b*, 14*a* and 14*b* are about equilateral with reference to one another and the wall panels 12*c*, 12*d*, 14*c* and 14*d* are also about equilateral with reference to one another. The wall panels 14*a* and 14*b* form a longitudinal laterally rearwardly tapering rib with one another outside the chevron wall member C and are joined medially of the rib with the intermediate strut wall 16 inside the chevron wall member, while the junction of the intermediate strut wall 16 with the pair of wall panels 12*a* and 12*b*, though also being inside the chevron wall member C, is medially behind the valley formed by the panels 12*a* and 12*b* outside the chevron wall member.

A front pair of connecting walls 19 and 20 and a back pair of connecting walls 21 and 22 of the gland 11 interconnect the opposite lateral ends of the strut walls 17 and 18 of the chevron wall member C with the opposite lateral ends of a second pair of strut walls 23 and 24 of the gland 11 which are shorter in reach fron front to back of the gland than the strut walls 17 and 18. The connecting walls 19 and 20 in the front pair are slanted between the forward lateral ends of the pair of strut walls 17 and 18 toward the forward lateral ends of the pair of strut walls 23 and 24, and thus converge with reference to the connecting walls 21 and 22 in the back pair. There are generally trapezoidal passageways 29 and 30 longitudinally through the gland 11, having the pair of strut walls 23 and 24 laterally and longitudinally about parallel with the pair of strut walls 17 and 18, while the strut walls 17, 18, 23 and 24 are closed boundaries for the passageways 29 and 30 with the front and back connecting walls 19, 20, 21 and 22. The strut walls 17, 18, 23 and 24 are about perpendicular to the back pair of connecting walls 21 and 22 as viewed in FIG. 2. Outer lateral end portions 19*a* and 20*a* of the front pair of connecting walls 19 and 20 and outer lateral end portions 21*a* and 22*a* of the back pair of connecting walls 21 and 22 are components of lateral end means of the gland 11 along with the second pair of strut walls 23 and 24 and a pair of longitudinal laterally rearwardly open-hooked lateral end anchors 25 and 26. The lateral end anchors 25 and 26 have a first pair of side walls 25*a* and 26*a* which provide forward extensions of the second pair of strut walls 23 and 24 and are interconnected with a second pair of side walls 25*c* and 26*c* by means of a pair of bight walls 25*b* and 26*b*, thus to have the side walls 25*c* and 26*c* lead backwardly and the anchors 25 and 26 define rearwardly laterally open grooves 25*e* and 26*e*.

Gland 11 preferably is an extrusion and is made of any suitable elastomeric material with or without being reinforced such as by fabric embedded in the elastomer. Also, as preferred, the gland 11 bi-laterally is approximately symmetrically configurated, having the intermediate strut wall 16 inside the chevron wall member C as a reference for symmetry.

The mounts 38 hereinbefore preliminarily described with reference to FIG. 1 as being used in system with gland 11 are oppositely faced toward one another across the movement tolerance space 43 between the relatively movable bodies 41 and 42, and are similar to one another and may be longitudinally prolonged, as need may be, by continuing with one or more of the mounts or mount components. One of the mounts 38 has the components thereof represented in FIGS. 3 and 4, and will be described to enable and understanding of the structure of the several mounts 38 assembled in system with gland 11 in FIG. 1 and applied to the relatively movable bodies 41 and 42.

As will be understood from FIG. 3, the base 40 for each of the mounts 38, has a top land 45, hereinbefore referred to as being disposed substantially flush at outer face with either of the relatively movable bodies 41 and 42 in FIG. 1, and a second land 50 joined with the top land 45 by a slanted transition face 53 of the base 40. The transition face 53 forms an acute angle with the second land 50, and thus a groove 52 which opens laterally across the second land 50, having the second land form a side of the groove 52. Laterally forwardly open grooves 55 and 56 in the base 40, and longitudinally co-extending substantially parallel with the groove 52, are between opposite side faces which are substantially parallel and are afforded by walls 54, 57 and 58. Groove 55 is entrant from the second land 50 into the base 40, between the walls 54 and 57, and groove 56 is entrant into the base 40 between the walls 57 and 58. Forward endwise, at portion 57*a*, the wall 57 provides part of the surface of the second land 50, and the wall 58 has a forward end 58*a* which is stepped backward from the second land 50 to an extent which hereinafter will be realized is needed. Outside the wall 58, the base 40 introduces the hereinbefore preliminarily mentioned laterally projecting rest wall 46 or ledge, longitudinally of the base 40. Extending forwardly from the rest wall 46, the base 40 includes the abutment face 47 about right angularly disposed with reference to a forward face 46*a* of the rest wall 46. The abutment face 47 merges with an outside face of the wall 58.

A generally L-shaped support and anchor member of the base 40 has a support leg wall 48 about right angularly related to the rest wall 46, with the leg wall backwardly leading from the rest wall 46 and thence connected with the anchor wall 59, so that the anchor wall and the rest wall 46 are directed laterally away from the support leg wall 48 in generally opposite senses, for the base 40 to be installed having the anchor wall 49 embedded, and thereafter have the leg wall 48 support the rest wall 46 and the remainder of the forward portion of base 40. All of the bases 40 used in the FIG. 1 installation, in being similar to one another, are for example metal products of extrusion.

When the bases 40 of the pair of mounts 38 are assembled with the elastomeric gland 11 as represented in FIG. 1, the grooves 56 in the bases (see also FIG. 3) accommodate the second side walls 25*c* and 26*c* of the gland anchors 25 and 26 therein, while the walls 58 of the pair of bases 40 project into the grooves 25*e* and 26*e* in the gland anchors, to have the bight walls 25*b* and 26*b* of the gland anchors extend about flush with those portions of the surfaces of the lands 50 afforded at the ends of walls 57 in the bases 40. With the anchors 25 and 26 thus engaged with the bases 40, the portions 21*a* and 22*a* of the back pair of connecting walls 21 and 22 are against the forward faces 46*a* of the pair of rest walls 46, and the back connecting walls thence extend laterally past free ends 46*c* of the rest walls out into the movement tolerance space 43 to the rearward lateral ends of the pair of strut walls 17 and 18 of the chevron wall member C. The chevron wall member C meanwhile projects backwardly in the movement tolerance space 43 between the relatively movable bodies 41 and 42 and thus reaches between the free ends 46*c* of the pair of rest walls 46, having the front and back pairs of connecting walls 19, 20, 21 and 22 support the chevron wall member and apply or relieve compressive thrust against the chevron wall member as the case may be, when the bodies 41 and 42 relatively move with reference to one another. Thrust is applied and relieved against the second pair of strut walls 23 and 24 of the gland from the bases 40 in the system while the strut walls 23 and 24 abut against the related abutment faces 47 of the bases 40 and the anchors 25 and 26 are engaged with the bases in the manner hereinbefore described. The outer lateral end portions 21*a* and 22*a* of the pair of back connecting walls 21 and 22 of the gland member meanwhile are seated against the rest walls 46.

Having reference to FIG. 4, a cover plate 60, such as of metal, to be used with the base 40, includes laterally opposite beveled edges 61 and 65 which longitudinally of the plate 60 are approximately parallel with one another. The bevel at edge 61 slants laterally from a top surface 62 of the plate toward a back surface 63 of the plate so as to produce a tongue which fits into the acute angle groove 52 in the base 40, thereby enabling plate 60 at the back surface 63 to be against the second land 50 of the base 40 while the top surface 62 of the plate is about flush with the top land 45 of the base 40. At the opposite edge 65, the bevel of plate 60 laterally slants forwardly and outwardly from the back surface 63 and leads to a nose 67 which is rounded outwardly back to the top surface 62 of the plate. Further, the plate 60 has a longitudinal row of apertures 64 which in the row extend from the front surface 62 to the back surface 63 of the plate, having the row about parallel with the edge 61 of the plate and disposed marginally inwardly from the latter edge. The body of plate 60 may be a product of extrusion, later drilled to provide the apertures 64 or, of course, may be produced in any other suitable manner.

When the cover plate 60 is in place on base 40, having the beveled edge 61 of the plate inserted into the groove 52 in the base 40, this quite helpfully aligns the apertures 64 with groove 55 in the base 40, to have the self-tapping screws 70 (see FIG. 1) thereafter be inserted through the apertures 64 and operated to self-tap the walls of groove 55, thus serving to secure the cover 60 to the base 40. Since all of the bases 40 and plates 60 used in the gland and mount system of FIG. 1 are similar as products that they are, the gland anchors 25 and 26, being also similar, are readily engaged with the bases 40 in a manner hereinbefore described and later are held in place by the cover plates 60 fastened to the bases by means of the self-tapping screws 70. Any one or more of the bases 40, are carried correspondingly by the relatively movable bodies 41 and 42 as need may be in view of length of the joint, and are covered by the plates 60 in number also as need may be.

From FIG. 1, it will be observed that the bevels at edges 65 of the cover plates 60 project laterally beyond the abutment faces 47 afforded for the gland 11 by the bases 40, and thus are forward of the rest walls 46 of the bases. The plates 60 accordingly are adapted to extend outside the front pair of connecting walls 19 and 20 of the gland and present the slants of the bevels of the plate ends 65 directly forward of the slanted front pair of connecting walls 19 and 20 of the gland. The gland 11 and the pair of mount means 38 in FIG. 1 are interrelated so that when the gland is fully compressed, the edges 65 of the cover plates 60 will be reasonably close to meeting one another.

In order to provide insight as to how the elastomeric gland 11 alters form, let it be assumed that the gland in the about fully relaxed FIG. 1 condition is continuously receiving thrust from the mounts 38 with having the movement tolerance space 43 continuously reducing in width due to relative movement of the bodies 41 and 42 toward one another. The inner lateral ends of the front and back pairs of connecting walls 19, 20, 21 and 22 at their connections with the forward and rearward lateral ends of the strut walls 17 and 18 of the chevron wall member C begin to carry the chevron wall member rearwardly, and the valley and the rib in the chevron wall member narrow, having the inner lateral ends of the front pair of connecting walls 19 and 20 approach one another until the gland reaches the FIG. 2*a* form. The gland in moving from the FIG. 2*a* form to the about fully compressed form represented in FIG. 2*b* has the chevron wall member continue to be carried rearwardly by the front and back pairs of connecting walls 19, 20, 21 and 22, for the chevron wall member further to narrow the rib and moreover erase the valley of the chevron wall member and have the chevron wall member, by being retracted rearwardly, allow the inner lateral end portions of the front pair of connecting walls 19 and 20 to approach one another and meet outer side facially to fill in where the valley in the chevron wall member has been and still further carry the chevron wall member rearwardly in co-operation with the back pair of connecting walls 21 and 22. The gland 11 accordingly reaches the FIG. 2*b* form. Faces of the pair of strut walls 17 and 18 of the chevron wall member meanwhile are against corresponding faces of the front wall portion 12 inside the chevron wall member, and faces of the back portion 14 of the chevron wall member are contiguous to the corresponding opposite side faces of the intermediate strut wall 16 inside the gland. Notably, too, the inner side faces of the second pair of strut walls 23 and 24 have closely approached the pair of strut walls 17 and 18 of the chevron wall member upon having the gland take the FIG. 2*b* form, and in all the lattice of the gland is quite densified. While the gland is being operated from the FIG. 2*b* form back to the FIG. 2 form, the front and back pairs of connecting walls 19, 20, 21 and 22 carry the chevron wall member in the forward direction having the chevron wall member restore the valley and widen the rib of the chevron wall member.

The present invention is, of course, in no way restricted to the specific disclosure of the specification and drawings herein, but also encompasses any modifications within the scope of the appended claims.

We claim:

1. Mount means for engaging longitudinal laterally rearwardly open-hooked anchor means on an elastomeric gland end with one of a pair of relatively movable bodies, and said mount means comprising: base means to be secured to said body and including, abutment means having an outside face to be abutted by said gland end, a first land to be about flush with the outside surface of said body when said base means is secured to said body, a second land set back from said first land, a transition portion between said first and second lands to be contacted when said second land is being covered, and groove-forming means defining longitudinal grooves in said base means longitudinally parallel with said transition portion, having a first one of said grooves enter said second land, for said base means to be tapped inside said first groove, and a second one of said grooves enter between said second land and a forwardly projecting wall of said abutment means, for said longitudinal laterally rearwardly open-hooked anchor means of said gland to receive said forwardly projecting wall of said abutment means and extend into said second groove in said base means and be about flush with said second land while said gland end abuts said outside face of said abutment means; and cover means comprising, front and rear surfaces for said front surface of said cover means to be about flush with said first land of said base means when said rear surface of said cover means is against said second land of said base means, and first and second lateral edges with there being a row of apertures from said front surface of said cover means to said rear surface of said cover means laterally offset from said first lateral edge of said cover means, and said first lateral edge of said cover means being adapted to be in contact with said transition portion of said base means, with said rear surface of said cover means being against said second land of said base means, to align said row of apertures in said cover means with said first groove in said base means, for screws to be inserted through said apertures and be driven to self-tap said base means inside said first groove and secure said cover means to said base means, having said cover means cover said second land of said base means and said anchor means between said first and second lateral edges of said cover means when said anchor means is engaged with said base means and said gland end abuts said outside face of said abutment means.

2. Mount means as set forth in claim 1, wherein said transition portion of said base means includes laterally projecting detent means for detaining said first lateral edge of said cover means against forward movement while said cover means is against said second land of said base means and said cover means is secured to said base means by said screws through said apertures in said cover means.

3. Mount means as set forth in claim 2, wherein said base means further includes rest means having a forward surface, and said cover means laterally extends forwardly of said forward surface of said rest means to said second lateral edge of said cover means when said cover means is secured to said base means by said screws through said apertures and covers said gland end when said gland end abuts said abutment means and rests against said forward surfaces of said rest means, with said anchor means being engaged with said base means.

4. Mount means as set forth in claim 3, wherein said cover means has a bevel locally along said rear surface thereof and extending to said second lateral edge, for said bevel to be forwardly opposite a slanted front portion of said gland end and said second lateral edge to be contiguous to said gland when said cover means is secured to said base means by said screws through said apertures in said cover means and said anchor means is engaged with said base means having said gland end abut said abutment means and rest against said rest means.

5. An elastomeric gland for being used within a movement tolerance space between relatively movable bodies laterally to narrow and widen with said space, and said gland including: a chevron wall member comprising, a pair of strut walls, and front valley-forming and back rib-forming portions interconnecting forward and rearward lateral ends of said pair of strut walls of said chevron wall member; an intermediate strut wall of said gland inside said chevron wall member about equilaterally between said pair of strut walls of said chevron wall member and connected with said front valley-forming and back rib-forming portions of said chevron wall member medially of said valley and said rib; and front and back connecting wall and opposite outer lateral end means including, front and back pairs of connecting wall means, and opposite outer lateral end means connected with said forward and rearward lateral ends of said pair of strut walls of said chevron wall member through said front and back pairs of connecting wall means, for said pair of strut walls of said chevron wall member to be about perpendicular to said back pair of connecting wall means and said first pair of connecting wall means to converge with reference to said back pair of connecting wall means toward said opposite outer lateral end means when said gland is in a substantially fully relaxed condition, and for said opposite outer lateral end means to be moved toward one another, and said front and back pairs of connecting wall means to carry said chevron wall member along with said intermediate strut wall rearwardly in said gland as said chevron wall member laterally narrows, and for said opposite outer lateral end means to be moved away from one another, and said front and back pairs of connecting wall means to carry said chevron wall member along with said intermediate strut wall forwardly in said gland as said chevron wall member laterally widens.

6. An elastomeric gland as set forth in claim 5, wherein said opposite outer lateral end means of said gland includes a pair of laterally outer strut walls shorter between said front and back pairs of connecting wall means than said pair of strut walls of said chevron wall member and interconnecting said front and back pairs of connecting wall means, having said pair of laterally outer strut walls be about perpendicular to said back pair of connecting wall means, and said front pair of connecting wall means converge with reference to said back pair of connecting wall means leading toward said pair of laterally outer strut walls, when said gland is in said relaxed condition.

7. An elastomeric gland as set forth in claim 6, wherein said intermediate strut wall and said chevron wall member define a first pair of longitudinal passageways through said gland, and said pair of strut walls of said chevron wall member, said laterally outer pair of strut walls and said front and back pairs of connecting wall means define a second pair of passageways longitudinally through said gland, when said gland is in said relaxed condition.

8. An elastomeric gland as set forth in claim 6, wherein said opposite outer lateral end means further comprises hooked anchor means extending from forward lateral ends of said pair of laterally outer strut walls and laterally rearwardly opening outside said laterally outer pair of strut walls.

9. An elastomeric gland as set forth in claim 5, wherein said front valley-forming portion of said chevron wall member includes first and second pairs of front wall panels, said first pair of front wall panels having first lateral ends connected with a forward lateral end of said intermediate strut wall of said gland and having second lateral ends interconnected by said second pair of front wall panels with said forward lateral ends of said pair of strut walls of said chevron wall member, with said second pair of front wall panels forming in said relaxed condition of said gland a pair of obtuse angles with said first pair of front wall panels inside said chevron wall member, and said rib-forming portion of said chevron wall member includes first and second pairs of back wall panels, said first pair of back wall panels having first lateral ends connected with a rearward lateral end of said intermediate strut wall of said gland and having second lateral ends interconnected by said second pair of back wall panels with said rearward lateral ends of said pair of strut walls of said chevron wall member, with said second pair of back wall panels forming in said relaxed condition of said gland a pair of obtuse angles with said first pair of back wall panels outside said chevron wall member, and with said panels in all of said first pairs being about equilateral and said panels in all of said second pairs being about equilateral.

10. An elastomeric gland as set forth in claim 9, wherein said strut walls of said chevron wall member pair are about perpendicular to said front and back pairs of second wall panels of said chevron wall member in said relaxed condition of said gland.

11. An elastomeric gland for being used within a movement tolerance space between relatively movable bodies laterally to narrow and widen with said space, and said gland including: a chevron wall member comprising, a pair of strut walls, and front valley-forming and back rib-forming portions interconnecting forward and rearward lateral ends of said pair of strut walls of said chevron wall member; an intermediate strut wall of said gland inside said chevron wall member about equilaterally between said pair of strut walls of said chevron wall member and connected with said front valley-forming and back rib-forming portions of said chevron wall member medially of said valley and said rib; and front and back wall and opposite outer lateral end means including, front and back pairs of connecting wall means, and opposite outer lateral end means connected through said front and back pairs of connecting wall means with said forward and rearward lateral ends of said pair of strut walls of said chevron wall member, and said front pair of connecting wall means having inner lateral front wall portions adjacent to said chevron wall member, for said opposite outer lateral end means to be moved toward one another, and said front and back pairs of connecting wall means to carry said chevron wall member along with said intermediate strut wall rearwardly in said gland as said chevron wall member laterally narrows, enabling said inner lateral front wall portions of said front pair of connecting wall means to be in a front facial confronting relation to one another forwardly of said chevron wall member and said intermediate strut wall when said gland laterally has been substantially fully narrowed between said opposite outer lateral end means, and for said opposite outer lateral end means to be moved away from one another, and said front and back pairs of connecting wall means to carry said chevron wall member along with said intermediate strut wall forwardly in said gland as said chevron wall member laterally widens.

12. An elastomeric gland as set forth in claim 11, wherein said inner lateral front wall portions of said front pair of connecting wall means front facially bear against one another forwardly of said chevron wall member and said intermediate strut wall when said gland laterally is substantially fully narrowed between said opposite outer lateral end means.

13. An elastomeric gland for being used within a movement tolerance space between relatively movable bodies laterally to narrow and widen with said space, and said gland including: a chevron wall member comprising, a pair of strut walls, and front valley-forming and back rib-forming portions interconnecting forward and rearward lateral ends of said pair of strut walls of said chevron wall member; and front and back connecting wall and opposite outer lateral end means comprising, front and back pairs of connecting wall means, and opposite outer lateral end means connected with said forward and rearward lateral ends of said pair of strut walls of said chevron wall member through said front and back pairs of connecting wall means, for said pair of strut walls of said chevron wall member to be about perpendicular to said back pair of connecting wall means and said front pair of connecting wall means to converge with reference to said back pair of back pair of connecting wall means toward said opposite outer lateral end means when said gland is in a substantially fully relaxed condition, and for said opposite outer lateral end means to be moved toward one another, and said front and back pairs of connecting wall means to carry said chevron wall member rearwardly in said gland as said chevron wall member laterally narrows, and for said opposite lateral end means to be moved away from one another, and said front and back pairs of connecting wall means to carry said chevron wall forwardly in said gland as said chevron wall member laterally widens.

14. An elastomeric gland as set forth in claim 13, wherein said opposite outer lateral end means of said gland comprises a pair of laterally outer strut walls shorter between said front and back pairs of connecting wall means than said pair of strut walls of said chevron wall member and interconnecting said front and back pairs of connecting wall means of said gland, having said pair of laterally outer strut walls be about perpendicular to said back pair of connecting wall means and said front pair of connecting wall means converge with reference to said back pair of connecting wall means as said front and back pairs of connecting wall means lead toward said laterally outer pair of strut walls in a relaxed condition of said gland.

15. An elastomeric gland for being used within a movement tolerance space between relatively movable bodies laterally to narrow and widen with said space, and said gland including: a chevron wall member comprising, a pair of strut walls, and front valley-forming and back rib-forming portions interconnecting forward and rearward lateral ends of said pair of strut walls of said chevron wall member; and front and back wall and opposite outer lateral end means including, front and back pairs of connecting wall means, and opposite outer lateral end means connected through said front and back pairs of connecting wall means with said forward and rearward lateral ends of said pair of strut walls of said chevron wall member, and said front pair of connecting wall means having laterally inner front wall portions adjacent to said chevron wall member, for said opposite outer lateral end means to be moved toward one another, and said front and back pairs of connecting wall means to carry said chevron wall member rearwardly in said gland as said chevron wall member laterally narrows, enabling said laterally inner front wall portions of said front pair of connecting wall means to be in a front facial confronting relation to one another forwardly of said chevron wall member when said gland laterally has been substantially fully narrowed between said opposite outer lateral end means, and for said opposite outer lateral end means to be moved away from one another, and said front and back pairs of connecting wall means to carry said chevron wall member forwardly in said gland as said chevron wall member laterally widens.

16. An elastomeric gland as set forth in claim 15, wherein said inner lateral front wall portions of said front pair of connecting wall means front facially bear against one another forwardly of said chevron wall member when said gland laterally is substantially fully narrowed between said opposite outer lateral end means.

17. A gland and mount system for use across a movement tolerance space between relatively movable bodies to have said gland laterally narrow and widen with said space, and said system comprising: a pair of mount means to be securely on said bodies and be laterally aside from one another in said movement tolerance space relatively to move with said bodies as said bodies narrow and widen said movement tolerance space, and an elastomeric gland including, a chevron wall member, and front and back connecting wall and opposite outer lateral end means; said chevron wall member comprising, a pair of strut walls, and front valley-forming and back rib-forming portions interconnecting forward and rearward lateral ends of said pair of strut walls of said chevron wall member, and said front and back connecting wall and opposite outer lateral end means comprising, front and back pairs of connecting wall means, and opposite outer lateral end means connected with said forward and rearward lateral ends of said pair of strut walls of said chevron wall member through said front and back pairs of connecting wall means, for said opposite outer lateral end means to be carried with said pair of mount means and said back pair of connecting wall means to extend laterally beyond said pair of mount means into said movement tolerance space to said chevron wall member, when said gland and said pair of mount means are disposed inside said movement tolerance space having said pair of mount means secured to said bodies, and for said front and back pairs of connecting wall means to carry said chevron wall member rearwardly in said gland with said chevron wall member laterally narrowing during a relative movement of said pair of mount means toward one another and carry said chevron wall member forwardly in said gland with said chevron wall member laterally widening during a relative movement of said pair of mount means away from one another.

18. A gland and mount system as set forth in claim 17, wherein said front connecting wall means in said pair in said gland have inner lateral wall portions adjacent to said chevron wall member, for said inner lateral wall portions of said front pair of connecting wall means to be moved relatively to one another in said gland into a front facial confronting relation to one another forwardly of said chevron wall member, incidental to said chevron wall member being carried rearwardly in said gland by said front and back pairs of connecting wall means and said gland laterally being substantially fully narrowed under thrust applied from said pair of mount means to said opposite outer lateral end means of said gland.

19. A gland and mount system as set forth in claim 17, wherein said gland, whenever substantially fully relaxed, is characterized by said strut walls of said chevron wall member being approximately perpendicular to said connecting wall means in said back pair, having said connecting wall means in said front pair converge with reference to said back pair of connecting wall means as said front and back pairs of connecting wall means lead toward said opposite outer lateral end means of said gland.

20. A gland and mount system as set forth in claim 17, wherein said pair of mount means includes a pair of laterally free-ended rest means as components thereof for said pair of rest means to support outer lateral wall portions of said back pair of connecting wall means of said gland and have inner lateral wall portions of said back pair of connecting wall means reach flexibly laterally beyond said free lateral ends of said pair of rest means to said chevron wall member when said chevron wall member is carried rearwardly in said gland between said lateral free ends of said pair of rest means by said front and back pairs of connecting wall means during a relative movement of said pair of mount means toward one another and when chevron wall member is carried forwardly in said gland between said lateral free ends of said pair of rest means by said front and back pairs of connecting wall means during a relative movement of said pair of mount means away from one another.

21. A gland and mount system as set forth in claim 20, wherein said front connecting wall means in said pair in said gland have inner lateral front wall portions adjacent to said chevron wall member, for said inner lateral front wall portions of said front pair of connecting wall means to be moved relatively to one another in said system into a front facial confronting relation to one another forwardly of said chevron wall member incidental to said chevron wall member being carried rearwardly in said gland by said front and back pairs of connecting wall means and said gland laterally being substantially fully narrowed under thrust applied from said pair of mount means to said opposite outer lateral end means of said gland.

22. A gland and mount system as set forth in claim 20, wherein laterally projecting frontal components of said pair of mount means are provided to be forward of said front pair of connecting wall means of said gland while said outer lateral wall portions of said back pair of connecting wall means are on said pair of rest means.

23. A gland and mount system as set forth in claim 22, wherein said gland whenever in a substantially fully relaxed condition is characterized by said pair of strut walls of said chevron wall member being about perpendicular to said back pair of connecting wall means of said gland, having said front pair of connecting wall means converge with reference to said back pair of connecting wall means leading toward said opposite outer lateral end means of said gland, and bevels of said laterally projecting frontal components of said pair of mount means lead to lateral ends of said pair of laterally projecting frontal components and provide slanted faces to confront said front pair of connecting wall means of said gland and have said gland be contiguous to said lateral ends of said laterally projecting frontal components when said outer lateral wall portions of said back pair of connecting wall means of said gland are on said pair of rest means and said gland laterally is being narrowed and widened.

24. A gland and mount system for use across a movement tolerance space between relatively movable bodies to have said gland laterally narrow and widen with said space, and said system comprising: a pair of mount means to be securely on said bodies and be laterally aside from one another in said movement tolerance space relatively to move with said bodies; and an elastomeric gland including, a chevron wall member, an intermediate strut wall, and front and back connecting wall and opposite outer lateral end means; said chevron wall member comprising, a pair of strut walls and front valley-forming and back rib-forming portions interconnecting forward and rearward lateral ends of said pair of strut walls of said chevron wall member, and said intermediate strut wall of said gland being inside said chevron wall member about equilaterally between said pair of strut walls of said chevron wall member and connected with said front valley-forming and back rib-forming portions of said chevron wall member medially of said valley and said rib, and said front and back connecting wall and opposite outer lateral end means comprising, front and back pairs of connecting wall means, and opposite outer lateral end means connected through said front and back pairs of connecting wall means with said forward and rearward lateral ends of said pair of strut walls of said chevron wall member, for said opposite outer lateral end means to be carried with said pair of mount means and said back pair of connecting wall means to extend laterally beyond said pair of mount means into said movement tolerance space to said chevron wall member, when said gland and said pair of mount means are disposed inside said movement tolerance space having said pair of mount means secured to said bodies, and for said front and back pairs of connecting wall means to carry said chevron wall member and said intermediate strut wall rearwardly in said gland with said chevron wall member laterally narrowing during a relative movement of said pair of mount means toward one another and carry said chevron wall member and said intermediate strut wall forwardly in said gland with said chevron wall member laterally widening during a relative movement of said pair of mount means away from one another.

25. A gland and mount system as set forth in claim 24, wherein said front connecting wall means in said pair in said gland have inner lateral front wall portions adjacent to said chevron wall member, for said inner lateral front wall portions of said front pair of connecting wall means to be moved relatively to one another in said gland into a front facial confronting relation to one another forwardly of said chevron wall member and said intermediate strut wall, incidental to said chevron wall member and said intermediate strut wall being carried rearwardly in said gland by said front and back pairs of connecting wall means and said gland laterally being substantially fully narrowed under thrust applied fron said pair of mount means to said opposite outer lateral end means of said gland.

26. A gland and mount system as set forth in claim 25, wherein said opposite outer lateral end means of said gland comprises a pair of laterally outer strut walls shorter between said front and back pairs of connecting wall means than said pair of strut walls of said chevron wall member and said pair of laterally outer strut walls interconnecting said front and back pairs of connecting wall means, and said gland, whenever in a substantially fully relaxed condition, having said pair of strut walls of said chevron wall member and said pair of laterally outer strut walls be about perpendicular to said back pair of connecting wall means and said front pair of connecting wall means converge with reference to said back pair of connecting wall means as said front and back pairs of connecting wall means lead toward said pair of laterally outer strut walls of said gland.

27. A gland and mount system as set forth in claim 26, wherein said intermediate strut wall and said chevron wall member define a first pair of longitudinal passageways through said gland, and said pair of strut walls of said chevron wall member and said pair of laterally outer strut walls together with said front and back pairs of connecting wall means define a second pair of longitudinal passageways through said gland when said gland is in said relaxed condition.

28. A gland and mount system as set forth in claim 27, wherein said opposite outer lateral end means of said gland further comprises hooked anchor means extending from forward lateral ends of said pair of laterally outer strut walls and laterally rearwardly opening outside said laterally outer pair of strut walls, and said pair of mount means includes engagable means for said pair of mount means to be engaged with said anchor means and thereafter be moved with said opposite outer lateral end means of said gland.

29. A gland and mount system as set forth in claim 25, wherein said strut walls of said chevron wall member pair are about perpendicular to said back pair of connecting wall means of said gland having said front pair of connecting wall means of said gland converge with reference to said back pair of connecting wall means as said front and back pairs of connecting wall means lead toward said opposite outer lateral end means of said gland, whenever said gland is in a substantially fully relaxed condition, and said pair of mount means includes a pair of laterally free-ended rest means as components thereof for said pair of rest means to support outer lateral wall portions of said back pairs of connecting wall means of said gland and have inner lateral wall portions of said back pair of connecting wall means reach flexibly laterally beyond said free lateral ends of said pair of rest means to said chevron wall member, for said chevron wall member to be carried rearwardly in said gland between said lateral free ends of said pair of rest means by said front and back pairs of connecting wall means during a relative movement of said pair of mount means toward one another, and for said chevron wall member to be carried by said front and back pairs of connecting wall means forwardly in said gland during a relative movement of said pair of mount means away from one another.

30. An elastomeric gland as set forth in claim 29, wherein said front valley-forming portion of said chevron wall member includes first and second pairs of front wall panels, said first pair of front wall panels having first lateral ends connected with a forward lateral end of said intermediate strut wall of said gland and having second lateral ends interconnected by said second pair of front wall panels with said forward lateral ends of said pair of strut walls of said chevron wall member, with said second pair of front wall panels forming in said relaxed condition of said gland a pair of obtuse angles with said first pair of front wall panels inside said chevron wall member, and said rib-forming portion of said chevron wall member includes first and second pairs of back wall panels, said first pair of back wall panels having first lateral ends connected with a rearward lateral end of said intermediate strut wall of said gland and having second lateral ends interconnected by said second pair of back wall panels with said rearward lateral ends of said pair of strut walls of said chevron wall member, with said second pair of back wall panels forming in said relaxed condition of said gland a pair of obtuse angles with said first pair of back wall panels outside said chevron wall member, and with all of said panels in all of said first pairs being about equilateral and said panels in all of said second pairs being about equilateral.

31. A gland and mount system for use across a movement tolerance space between relatively movable bodies to have said gland laterally narrow and widen with said space, and said system comprising: a pair of mount means to be securely on said bodies and be laterally aside from one another in said movement tolerance space relatively to move with said bodies; and an elastomeric gland including, a laterally collapsible and expansible central member having laterally opposite sides for said laterally opposite sides to move toward one another as said central member laterally is being narrowed and away from one another as said central member laterally is being widened; and front and back connecting wall and opposite outer lateral end means including front and back pairs of connecting wall means, and opposite outer lateral end means connected through said front and back pairs of connecting wall means with forward and rearward lateral ends of said opposite sides of said central member, and said front pair of connecting wall means having inner lateral front wall portions adjacent to said central member, for said opposite outer lateral end means to be on said pair of mount means having said back pair of connecting wall means extend laterally beyond said pair of mount means into said movement tolerance space to said central member, and said pair of mount means to carry said opposite outer lateral end means of said gland toward one another as said front and back pairs of connecting wall means carry said central member rearwardly in said gland and said central member laterally narrows, enabling said inner lateral front wall portions of said front pair of connecting wall means to be in a front facial confronting relation to one another forwardly of said central member when said gland laterally has been substantially fully narrowed between said pair of mount means, and for said pair of mount means to carry said opposite outer lateral end means away from one another as said front and back pairs of connecting wall means carry said central member forwardly in said gland and said central member laterally widens.

32. A gland and mount system as set forth in claim 31, wherein said inner lateral front wall portions of said front pair of connecting wall means front facially bear against one another forwardly of said central member when said gland laterally is substantially fully narrowed between said opposite outer lateral end means.

33. An elastomeric gland for being used within a movement tolerance space between relatively movable bodies laterally to narrow and widen with said space, and said gland including: a laterally collapsible and expansible central member having laterally opposite sides for said laterally opposite sides to move toward one another as said central member laterally is narrowed and away from one another as said central member laterally is widened; and front and back wall and opposite outer lateral end means including, front and back pairs of connecting wall means exteriorily of said gland, and opposite outer lateral end means connected through said exterior front and back pairs of connecting wall means with forward and rearward ends of said laterally opposite sides of said central member, and said front pair of connecting wall means having inner lateral front wall portions adjacent to said central member, for said opposite outer lateral end means to be moved toward one another, and said front and back pairs of connecting wall means to carry said central member rearwardly in said gland as said central member laterally narrows, enabling said inner lateral front wall portions of said front pair of connecting wall means to be in a front facial confronting relation to one another forwardly of said central member when said gland laterally has been substantially fully narrowed between said opposite outer lateral end means, and for said opposite outer lateral end means to be moved away from one another, and said front and back pairs of connecting wall means to carry said central member forwardly in said gland as said central member laterally widens.

34. An elastomeric gland as set forth in claim 33, wherein said inner lateral front wall portions of said front pair of connecting wall means front facially bear against one another forwardly of said central member when said gland laterally is substantially fully narrowed between said opposite outer lateral end means.

* * * * *